US005202736A

United States Patent [19]

Komurasaki

[11] Patent Number: 5,202,736

[45] Date of Patent: Apr. 13, 1993

[54] IMAGE RECORDING EQUIPMENT HAVING MOVABLE TRAY RECEIVING SHEETS HAVING IMAGES FORMED THEREON

[75] Inventor: Takeshi Komurasaki, Yokohama, Japan

[73] Assignee: Ricoh Company, Ltd., Tokyo, Japan

[21] Appl. No.: 737,649

[22] Filed: Jul. 30, 1991

[30] Foreign Application Priority Data

Jul. 30, 1990 [JP] Japan ..... 2-199080

[51] Int. Cl.[5] ..... G03G 21/00; B65H 29/00

[52] U.S. Cl. ..... 355/308; 271/186; 271/291; 355/321

[58] Field of Search ..... 355/308, 309, 318, 319, 355/321; 271/186, 291, 298

[56] References Cited

U.S. PATENT DOCUMENTS 4,147,426 4/1979 Miyoshi et al. ..... 355/309
4,375,326 3/1983 Lang ..... 355/319
4,585,336 4/1986 Tanaka ..... 355/319
4,956,678 9/1990 Kiya et al. ..... 355/318
5,034,780 7/1991 Kotabe et al. ..... 355/321 X

*Primary Examiner*—Fred L. Braun
*Attorney, Agent, or Firm*—Oblon, Spivak, McClelland, Maier & Neustadt

[57] ABSTRACT

Image recording equipment capable of selectively discharging sheets each carrying an image thereon to either one of the operating side or front of the equipment where the operator is expected to stand or to the opposite side or rear, depending on the number of sheets to be discharged to a tray. When a tray provided on the rear of the equipment is selected, the tray loaded with discharged sheets is moved to the front of the equipment and then automatically returned to the original position after the sheets have been removed by the operator.

4 Claims, 4 Drawing Sheets

IMAGE RECORDING EQUIPMENT HAVING MOVABLE TRAY RECEIVING SHEETS HAVING IMAGES FORMED THEREON

BACKGROUND OF THE INVENTION

The present invention relates to image recording equipment capable of selectively discharging sheets each carrying an image thereon to either one of the operating side of the equipment where the operator is expected to stand and the side opposite thereto, depending on the number of sheets to be discharged to a tray.

In a copier, facsimile transceiver, printer or similar image recording equipment, sheets each carrying an image thereon are sequentially driven out to a tray face down in order of page and then removed from the tray by the operator. Usually, the tray is located on the side of the equipment opposite to the operating side where the operator is expected to stand. Let the operating side and the side opposite thereto be referred to as the front and the rear, respectively. In such a configuration, the operator cannot remove the sheets from the tray unless the operator makes a long arm for the sheets. This is especially true when the recording equipment is large size. In light of this, the sheet discharge path may be switched over to discharge the sheets to the top of the equipment in place of the tray located on the rear of the equipment. This, however, causes the sheets to be discharged face up to the top of the equipment and, therefore, in the reverse order with respect to page. As a result, the operator has to rearrange the pages of the sheets after all the sheets have been discharged.

SUMMARY OF THE INVENTION

It is therefore an object of the present invention to provide image recording equipment capable of selectively discharging sheets each carrying an image thereon to either one of the front and the rear of the equipment, depending on the number of sheets to be discharged to a tray.

It is another object of the present invention to provide generally improved image recording equipment.

Image recording equipment for recording an image on a sheet and then discharging the sheet of the present invention comprises a first tray provided on the operating side of the equipment where an operator is expected to stand for stacking sheets sequentially driven out of the equipment and each carrying an image thereon, a second tray provided on the opposite side to the operating side for stacking sheets sequentially driven out of the equipment and each carrying an image thereon, a selector for selecting either one of the first and second trays to be loaded with sheets, depending on the number of the sheets, and a mechanism for moving the second tray loaded with sheets to a predetermined position on the operating side of the equipment.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
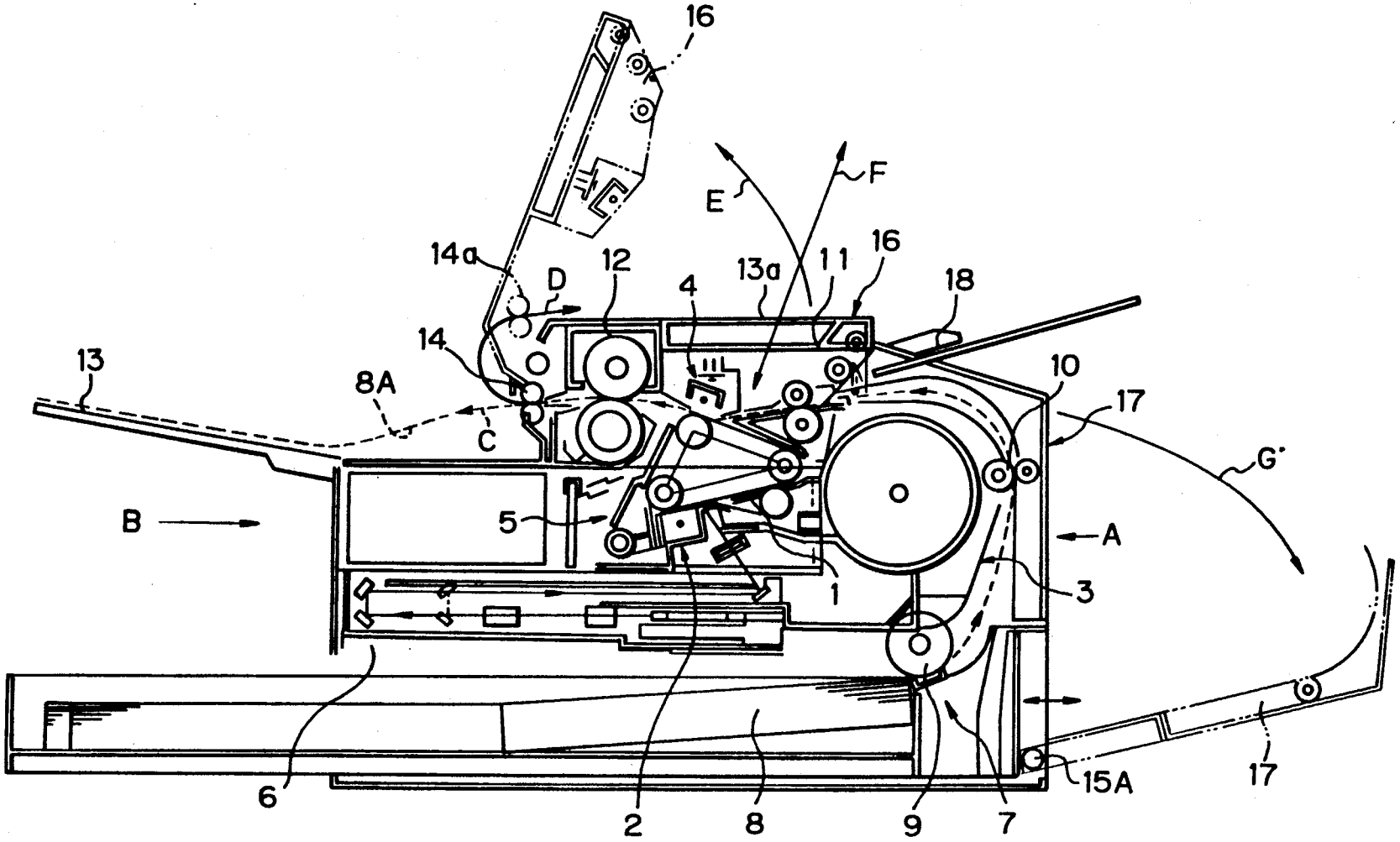
Fig. 1 PRIOR ART
FIG. 1 is a section showing the general construction of conventional image recording equipment to which the present invention is applied.

Referring to FIG. 1 of the drawings, conventional image recording equipment with which the present invention is practicable is shown and includes a photoconductive element in the form of a belt 1. Arranged around the belt 1 are a charger 2, a developing device 3, an image transfer device 4, and a cleaning device 5. An optical writing device 6 is disposed below the belt 1 while a sheet cassette 7 is disposed below the writing device 6. A recording medium in the form of a sheet 8 is fed from the cassette 7 to a register device 11 by a pick-up roller 9 and an intermediate roller 10, as indicated by a dotted line in the figure. The register device 11 drives the sheet 8 toward the belt 1 at a predetermined timing. The image transfer device 4 transfers a toner image from the belt 1 to the sheet 8. A fixing device 12 fixes the toner image on the sheet 8. Thereafter, the sheet 8 is driven out of the equipment face down, i.e., with the side 8A thereof carrying the toner image facing downward, as indicated by an arrow C. Specifically, the sheet 8 is discharged onto a tray 13 which is provided on the rear B of the equipment opposite to the front or operating side A where the operator is expected to operate the equipment.

The equipment shown in FIG. 1 is of the type causing the image transfer device 4 to transfer a toner image to the lower side of the sheet 8 and then causing the fixing device 12 to fix the toner image on the sheet 8. When the sheet 8 jams the register device 11 or the fixing device 12, an upper unit 16 forming part of the equipment may be rotated or opened about a shaft, not shown, in a direction indicated by an arrow E. Then, the jamming sheet 8 can be readily removed from the equipment. The belt 1 is also removable in a direction indicated by an arrow F to be replaced with a new belt. A front unit 17 forming another part of the equipment is rotatable to an open position about a shaft 15A, as indicated by an arrow G in the figure. When opened, the front unit 17 facilitates the insertion and removal of the sheet cassette 7, the removal of a sheet 8 having jammed the transport path around the pick-up roller 9 or the intermediate roller 10, and the insertion and removal of the developing device 3. A display panel and a control panel, not shown, are mounted on the front A of the equipment. A manual sheet insertion unit 18 is located in the vicinity of the upper unit 16.

The problem with the conventional equipment described above is that the operator standing by the front A of the equipment cannot easily take up the sheets 8 driven out to the tray 13 since the tray 13 is located at the rear B of the equipment. To eliminate this problem, a discharge roller 14*a* may be disposed above a discharge roller 14 so as to discharge the sheets 8 in a direction indicated by an arrow D. Then, the sheets 8 will be driven out to the top of the upper unit 16, or another tray, 13*a*. This kind of scheme, however, has a drawback that since the sheet 8 is discharged to the tray 13*a* with the image side 8A thereof facing upward, a plurality of consecutive sheets 8 each carrying an image thereon would be reverese with respect to the page when driven out onto the tray 13*a*. Then, the operator having removed such sheets 8 from the tray 13*a* have to rearrange them in order of page, wasting much time and labor.

Figure 2:
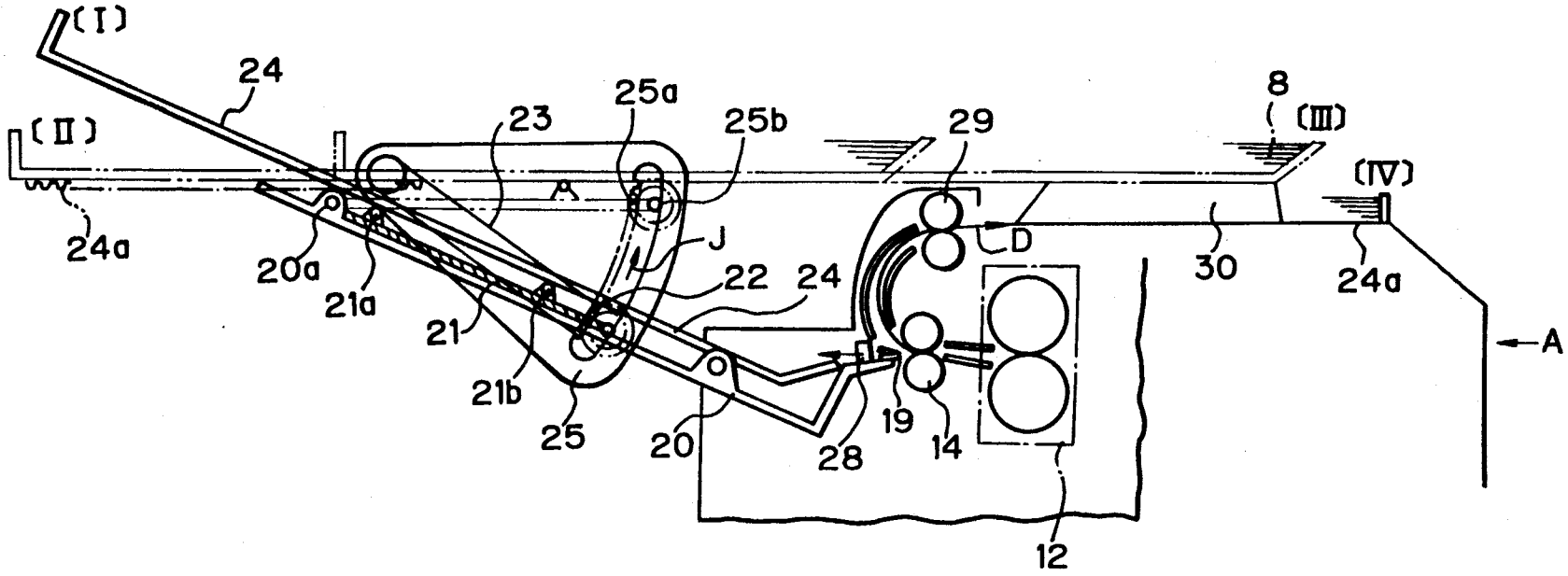
FIG. 2 is a sectional side elevation of a mechanism for driving a tray which is included in image recording equipment embodying the present invention.

A preferred embodiment of the image recording equipment of the present invention will be described with reference to FIG. 2. As shown, a path selector implemented as a pawl 19 is located downstream of a discharge roller 14 with respect to an intended direction of sheet transport. An actuator, not shown, is ON/OFF controlled by a signal sent thereto from a controller, not shown. The actuator drives the path selector 19 to select either one of two different transport paths represented by arrows C and D. A sheet 8 is transported along the path C with the image side 8A thereof facing downward, so that sheets 8 will be stacked in order of page even when the number of sheets is great. On the other hand, a sheet 8 steered to the path D by the path selector 19 is discharged with the image side 8A thereof facing upward. Therefore, the path D does not allow the sheets to be stacked in order of page. Specifically, the path selector 19 selects the path D when only several sheets should be discharged or selects the path C when a number of sheets should be discharged.

A number of sheets 8 routed through the path C are sequentially driven out to a tray 24 and stacked thereon in order of page. Hereinafter will be described a mechanism for moving the tray 24 to the front A of the equipment to allow the operator standing there to readily take up the stack of sheets from the tray 24.

A tray support plate 20 is removably mounted on the side wall of the equipment. An elevation arm 21 is rotatably connected at one end thereof to the tray support plate 20 by a shaft 20*a*. An elevation gear pulley 22 is mounted on the other end of the elevation arm 21 while a timing belt 23 is passed over the pulley 22. Rollers 21*a* and 21*b* are rotatably mounted on the elevation arm 21 and spaced apart from each other. The tray 24 rests on the rollers 21*a* and 21*b* while being guided at the right and left edges thereof. The tray 24 has a rack 24*a* capable of meshing with a gear 24*b* which will be described.

Figure 3:
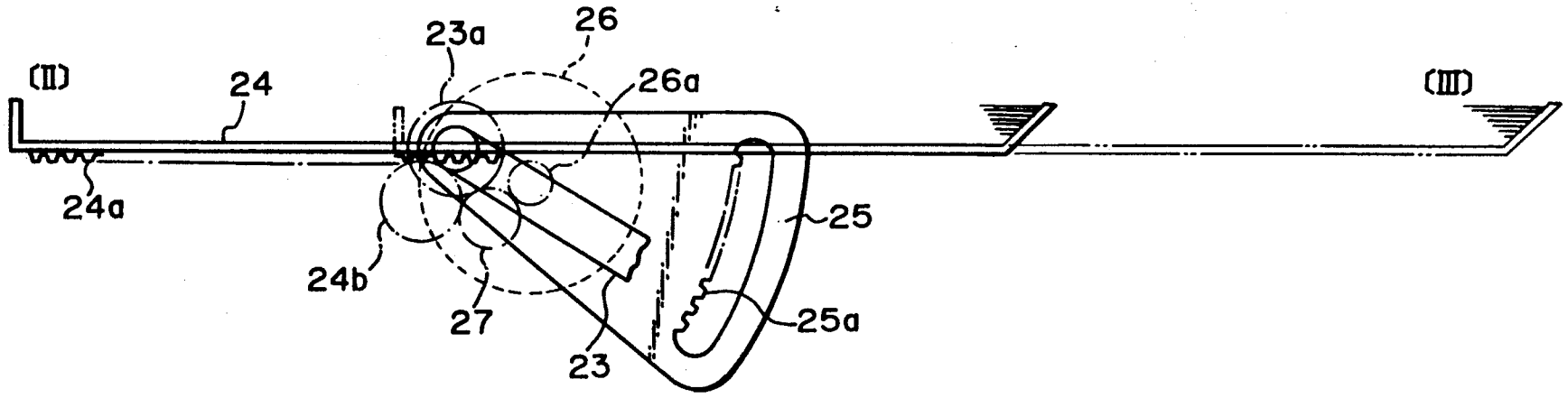
FIG. 3 is a sectional side elevation showing essential part of the mechanism of FIG. 2 more specifically.

A triangular side plate 25 is affixed to the side wall of the equipment and formed with a rack 25*a* in a base portion thereof. Specifically, as shown in FIG. 3, a motor gear 26*a* is mounted on the output shaft of a motor 26 and held in mesh with a switching gear 27. The switching gear 27 selectively transfers the rotation of the motor gear 26*a* to a gear pulley 23*a* which drives the timing belt 23 or to a tray gear 24*b* which moves the tray 24. A plunger magnet, not shown, is ON/OFF controlled by a signal from the controller, not shown, to actuate the switching gear 27 in the above-mentioned manner.

Referring again to FIG. 2, a sheet sensor 28 is located downstream of and in close proximity to the path selector 19 for sensing a sheet 8 having been discharged to the path C. A discharge roller 29 and a guide 30 transport a sheet 8 having been discharged to the other path D to a tray 24*a* which is provided on the front A of the equipment.

In operation, the tray 24 loaded with a number of sheets 8 which were routed through the path C is moved toward the front A of the equipment. Specifically, on the elapse of a predetermined period of time after the sheets 8 have passed the sheet sensor 28, it is determined that all the sheets have been discharged, and then the motor 26 is rotated counterclockwise. The motor 26 in turn rotates the timing belt 23 via the drive pulley 23*a* with the result that the elevation gear pulley 22 tends to rotate counterclockwise. The elevation gear pulley 22 is held in mesh with the rack 25*a* and, therefore, moves upward, as indicated by an arrow J in FIG. 2. As a result, the elevation arm 21 and tray 24 are raised, and the tray 24 is shifted from an inclined position [I] to a horizontal position [II]. In this condition, the elevation gear pulley 22 remains in a halt within a slot 25*b* which is formed through the side plate 25, bearing the weight of the sheets 8 and tray 24.

Subsequently, in response to a signal from the controller, the plunger magnet releases the switching gear 27 from the drive gear pulley 23*a* and brings it into mesh with the tray gear 24*b*. As a result, the rotation of the motor 26 is transmitted to the rack 24*a* of the tray 24, moving the tray 24 from the horizontal position [II] to an advanced position [III]. In the advanced position [III], the tray 24 allows the operator standing by the front A of the equipment to readily remove the stack of sheets 8 therefrom.

After the operator has removed the sheets 8 from the tray 24, the tray 24 is automatically returned from the advanced position [III] to the original position, as follows.

Figure 4:
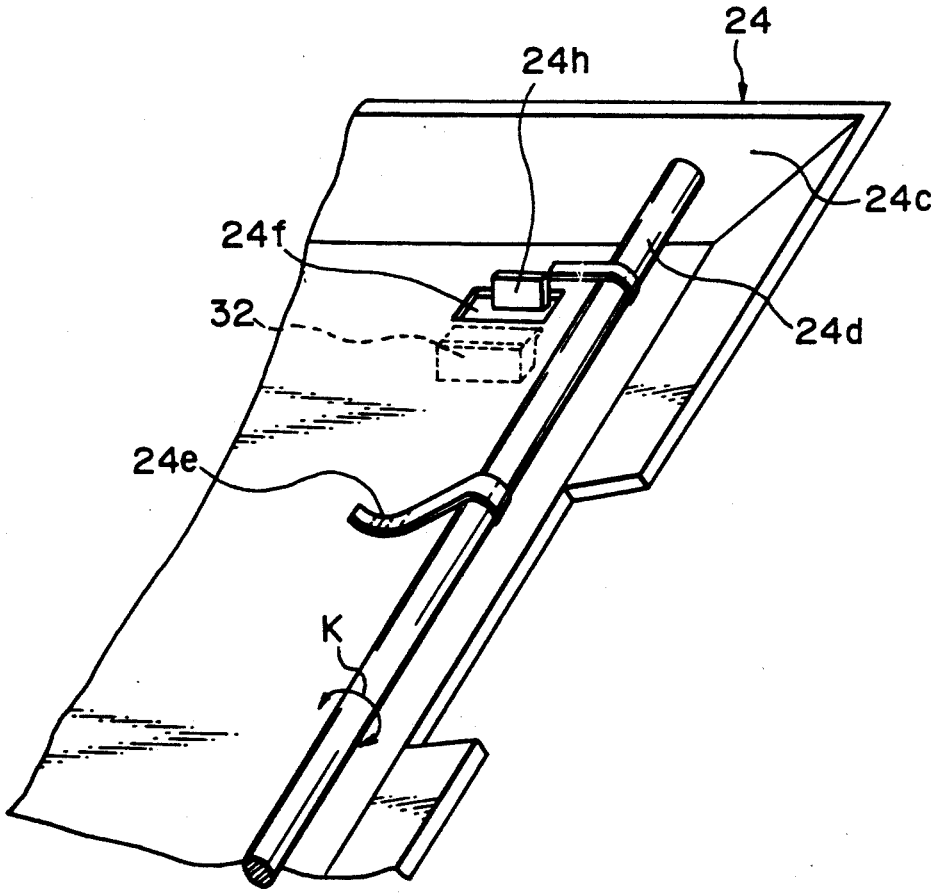
FIG. 4 is a perspective view showing a sheet sensor provided on the tray.

FIG. 4 shows part of the tray 24 and a sheet sensor 32 mounted on the tray 24. As shown, a shaft 24*d* is journalled to opposite side walls 24*c* (only one is visible) of the tray 24. A feeler 24*e* is affixed to the shaft 24*d* for rotating the latter in a direction indicated by a double-headed arrow k, depending on the height of the stack of sheets 8. A hole 24*f* is formed through the bottom wall of the tray 24 in a portion of the latter where the sheets 8 will not be stacked. A sheet sensor 32 is located immediately below the hole 24*f*. A shutter 24*h* is also affixed to the shaft 24*d* and capable of interrupting the optical path of the sheet sensor 32. In such a construction, when the operator removes the sheets 8 from the tray 24 which is held in the advanced position [III], the feeler 24*e* and shutter 24*h* are lowered. Then, the shutter 24*h* interferes with the sheet sensor 32 with the result that an end signal representative of the absence of sheets 8 is sent to the controller. In response, the controller executes a sequence of steps opposite to the sequence having been described with reference to FIGS. 2 and 3. Consequently, the tray 24 is returned from the advanced position [III] to the inclined position [I] via the horizontal position [II], preparing for the next recording operation.

Assume that the number of sheets 8 to be driven out of the equipment is small. Then, such sheets 8 are steered to the path D by the path selector 19. The sheets 8 each is transported along the guide 30 by the discharge roller 29 and then discharged onto the tray 24*a* which is provided on the front A of the equipment. The resulted position of the sheets 8 is labeled [IV] in FIG. 2. So long as the number of sheets 8 is small, rearranging them in order of page needs a minimum of time and labor despite that they are discharged face up.

In summary, in accordance with the present invention, sheets carrying images thereon are selectively driven out to a tray located on the front of recording equipment or to a tray located on the rear of the equipment, depending on the number of sheets to be discharged. The tray on the rear of the equipment and, therefore, the sheets stacked thereon can be moved to the front to promote easy removal thereof. After the sheets have been removed from the tray, the tray is automatically returned to the original position to prepare for the next recording operation, enhancing the operability of the equipment. Further, when the number of sheets to be discharged is small, the sheets are driven out to the tray on the front of the equipment. This mode of sheet discharge will be useful when a small number of sheets are discharged frequently.

Various modifications will become possible for those skilled in the art after receiving the teachings of the present disclosure without departing from the scope thereof.

What is claimed is:

1. Image recording equipment for recording an image on a sheet and then discharging said sheet outside a housing of the equipment, comprising:

a first tray provided on an operating side of said equipment adjacent which an operator is expected to stand for stacking sheets sequentially driven out of said equipment and each carrying an image thereon, such that sheets loaded in said first tray can be removed by an operator standing adjacent said operating side of said equipment;

a second tray provided on a side opposite to said operating side for stacking sheets sequentially driven out of said equipment and each carrying an image thereon;

selecting means for selecting either one of said first and second trays to be loaded with sheets; and moving means for moving said second tray loaded with sheets to a predetermined position on said operating side of said equipment with said predetermined position external to said housing of said equipment, such that sheets loaded in said second tray can be removed by an operator standing adjacent said operating side of said equipment.

2. Equipment as claimed in claim 1, further comprising returning means for returning said second tray having been moved to said predetermined position by said moving means to said side opposite to the operating sides of said equipment.

3. Equipment as claimed in claim 2, further comprising sensor means for determining whether or not sheets are present on said second tray, said returning means returning said second tray to said side opposite said operating side when said sensor means has determined that sheets are absent on said second tray.

4. Equipment as claimed in claim 1, wherein said selecting means selects said first tray when the number of sheets to be discharged is small and selects said second tray when the number of sheets is great.

* * * * *